US009879543B2

(12) United States Patent
Norris et al.

(10) Patent No.: US 9,879,543 B2
(45) **Date of Patent: *Jan. 30, 2018**

(54) HYBRID VAPOR AND FILM COOLED TURBINE BLADE

(75) Inventors: James W. Norris, Lebanon, CT (US); James D. Hill, Tolland, CT (US)

(73) Assignee: United Technologies Corporation, Farmington, CT (US)

( * ) Notice: Subject to any disclaimer, the term of this patent is extended or adjusted under 35 U.S.C. 154(b) by 2346 days.

This patent is subject to a terminal disclaimer.

(21) Appl. No.: 12/502,727

(22) Filed: Jul. 14, 2009

(65) Prior Publication Data

US 2013/0142665 A1 Jun. 6, 2013

Related U.S. Application Data

(63) Continuation of application No. 11/542,097, filed on Oct. 3, 2006, now Pat. No. 7,578,652.

(51) Int. Cl.

| | |
|---|---|
| ***F01D 5/18*** | (2006.01) |
| ***F01D 5/08*** | (2006.01) |
| ***F01D 5/30*** | (2006.01) |

(52) U.S. Cl.

CPC ..... *F01D 5/18* (2013.01); *F01D 5/082* (2013.01); *F01D 5/181* (2013.01); *F01D 5/187* (2013.01); *F01D 5/3007* (2013.01); *F05D 2260/202* (2013.01); *F05D 2260/205* (2013.01); *F05D 2260/207* (2013.01); *F05D 2260/22141* (2013.01)

(58) Field of Classification Search

USPC ..... 415/95, 96 A, 96 R, 97 R, 114, 115; 416/114, 115, 95, 96 A, 96 R, 97 R

See application file for complete search history.

(56) References Cited

U.S. PATENT DOCUMENTS

| | | | | |
|---|---|---|---|---|
| 2,708,564 A * | 5/1955 | Erickson | ..... | 415/114 |
| 2,755,062 A | 7/1956 | Hill | | |
| 3,287,906 A | 11/1966 | McCormick | | |
| 3,334,685 A | 8/1967 | Burggraf et al. | | |
| 3,376,918 A * | 4/1968 | Foure et al. | ..... | 165/47 |

(Continued)

FOREIGN PATENT DOCUMENTS

| | | |
|---|---|---|
| GB | 800517 | 8/1958 |
| GB | 1516041 | 6/1978 |

(Continued)

OTHER PUBLICATIONS

Extended European Search Report in foreign Application No. 07253811.9, filed Sep. 26, 2007.

*Primary Examiner* — Dwayne J White

(74) *Attorney, Agent, or Firm* — Kinney & Lange, P.A.

(57) ABSTRACT

A cooling system for cooling a fluid reaction apparatus of a gas turbine engine includes a vapor cooling subsystem and a film cooling subsystem. The vapor cooling subsystem has a vaporization section and a condenser section for cooling a portion of the fluid reaction apparatus. The condenser section is cooled by a fluid. The film cooling subsystem is configured for cooling a portion of the fluid reaction apparatus by discharging fluid out of openings defined in the fluid reaction apparatus. At least a portion of the fluid used to cool the condenser section of the vapor cooling subsystem is discharged out of the openings of the film cooling subsystem.

20 Claims, 4 Drawing Sheets

(56) References Cited

U.S. PATENT DOCUMENTS

| | | | | |
|---|---|---|---|---|
| 5,151,012 | A * | 9/1992 | Hough | 416/95 |
| 5,201,634 | A * | 4/1993 | Hough | 416/96 R |
| 5,634,766 | A * | 6/1997 | Cunha et al. | 415/115 |
| 5,857,836 | A | 1/1999 | Stickler et al. | |
| 5,954,478 | A | 9/1999 | Stickler et al. | |
| 5,975,841 | A | 11/1999 | Lindemuth et al. | |
| 6,142,730 | A * | 11/2000 | Tomita et al. | 415/115 |
| 6,931,834 | B2 | 8/2005 | Jones | |
| 6,974,306 | B2 * | 12/2005 | Djeridane et al. | 416/1 |
| 6,981,845 | B2 | 1/2006 | Balland et al. | |
| 6,988,367 | B2 | 1/2006 | Thompson Jr. et al. | |
| 7,578,652 | B2 * | 8/2009 | Norris et al. | 415/115 |
| 2006/0120855 | A1 | 6/2006 | Djeridane et al. | |
| 2007/0022732 | A1 | 2/2007 | Holloway et al. | |

FOREIGN PATENT DOCUMENTS

| | | | |
|---|---|---|---|
| GB | 2087980 | A | 6/1982 |
| GB | 2 254 380 | A | 10/1992 |
| WO | WO2005073539 | A1 | 8/2005 |

* cited by examiner

HYBRID VAPOR AND FILM COOLED TURBINE BLADE

CROSS-REFERENCE TO RELATED APPLICATION(S)

This application is a continuation of U.S. parent application Ser. No. 11/542,097, filed Oct. 3, 2006, which published as U.S. Pat. App. Pub. No. 2008/0080980.

BACKGROUND

The present invention relates to cooling systems for fluid reaction devices for gas turbine engines.

In order to operate a gas turbine engine at optimal conditions, temperatures in the hot region of the primary gas flowpath are often very high. High temperatures can have negative effects on engine components exposed to the primary flowpath, increasing risks for component degradation and failure. Indeed, temperatures at some points along the primary flowpath can exceed the melting points of materials used to form some engine components. For that reason, cooling systems are used to reduce damage and wear on engine components associated with high temperature conditions. Vapor cooling systems (synonymously called evaporative cooling systems) have been proposed as a way to cool fluid reaction devices in gas turbine engines, such as turbine blades and vanes. In general, these vapor cooling systems include sealed internal cavities and passageways that form a vaporization section and a condenser section. A liquid is distributed to the vaporization section, which is located in a portion of the blade or vane that is exposed to high temperatures (typically the airfoil portion). The liquid absorbs thermal energy and is converted to a gas as the liquid surpasses its boiling point. The gas moves through the sealed cavities and passageways to the condenser section, where thermal energy is removed and the gas is converted back to a liquid. Thermal energy is typically removed from the condenser section of the vapor cooling system by passing engine bleed air along exterior surfaces of the condenser section. The liquid from the condenser section is then returned to the vaporization section, and the process can begin again.

Known designs present a number of problems that hinder and may prevent the effective implementation of a vapor cooling scheme in gas turbine engines. One such problem is that vapor cooling systems are ineffective in cooling the trailing edges of the airfoils of turbine blades or vanes. Vaporization chambers for a hot airfoil section of a turbine blade or vane require internal passageways that take up significant space. However, the trailing edges of airfoils are thin sections that do not provide adequate space for internal vaporization section structures and passageways. Normally, this would mean that only a leading edge portion of the airfoil would be vapor cooled, while the trailing edge would remain uncooled. However, inadequate trailing edge cooling is undesirable and may prevent the practical application of vapor cooling in gas turbine engines. Conversely, increasing the cooling of the leading edge portion to indirectly cool the trailing edge can result in over-cooling of the leading edge of the blade or vane, which can reduce engine performance undesirably.

Furthermore, vapor cooling systems typically cool the condenser, which is typically located within a root portion of the cooled blade or vane, by passing engine bleed air around it. However, known vapor cooling systems do not provide for an efficient exhaust path for the "spent" bleed air that has absorbed thermal energy from the condenser. Spent bleed air allowed to seep into the primary airflow at an angle can cause undesired mixing loss, which reduces engine power efficiency and fuel efficiency.

It is desired to provide a cooling system for a turbine blade or vane that utilizes vapor cooling of the airfoil while also providing adequate cooling to the airfoil trailing edge. It is further desired to provide an efficient exhaust route for spent air used to cool a condenser of a vapor cooling system for a turbine blade or vane.

SUMMARY

A cooling system for cooling a fluid reaction apparatus of a gas turbine engine according to the present invention includes a vapor cooling subsystem and a film cooling subsystem. The vapor cooling subsystem has a vaporization section and a condenser section for cooling a portion of the fluid reaction apparatus. The condenser section is cooled by a fluid. The film cooling subsystem is configured for cooling a portion of the fluid reaction apparatus by discharging fluid out of openings defined in the fluid reaction apparatus. At least a portion of the fluid used to cool the condenser section of the vapor cooling subsystem is discharged out of the openings of the film cooling subsystem.

DETAILED DESCRIPTION

In general, the present invention provides a hybrid cooling system that can provide vapor cooling (synonymously called evaporative cooling) to a leading edge portion of an airfoil of a turbine blade or vane along with film cooling to a trailing edge portion of the airfoil. Furthermore, air used to cool a condenser of a vapor cooling subsystem can be directed to a film cooling subsystem, which exhausts the air into a primary engine flowpath in an efficient manner.

Figure 1:
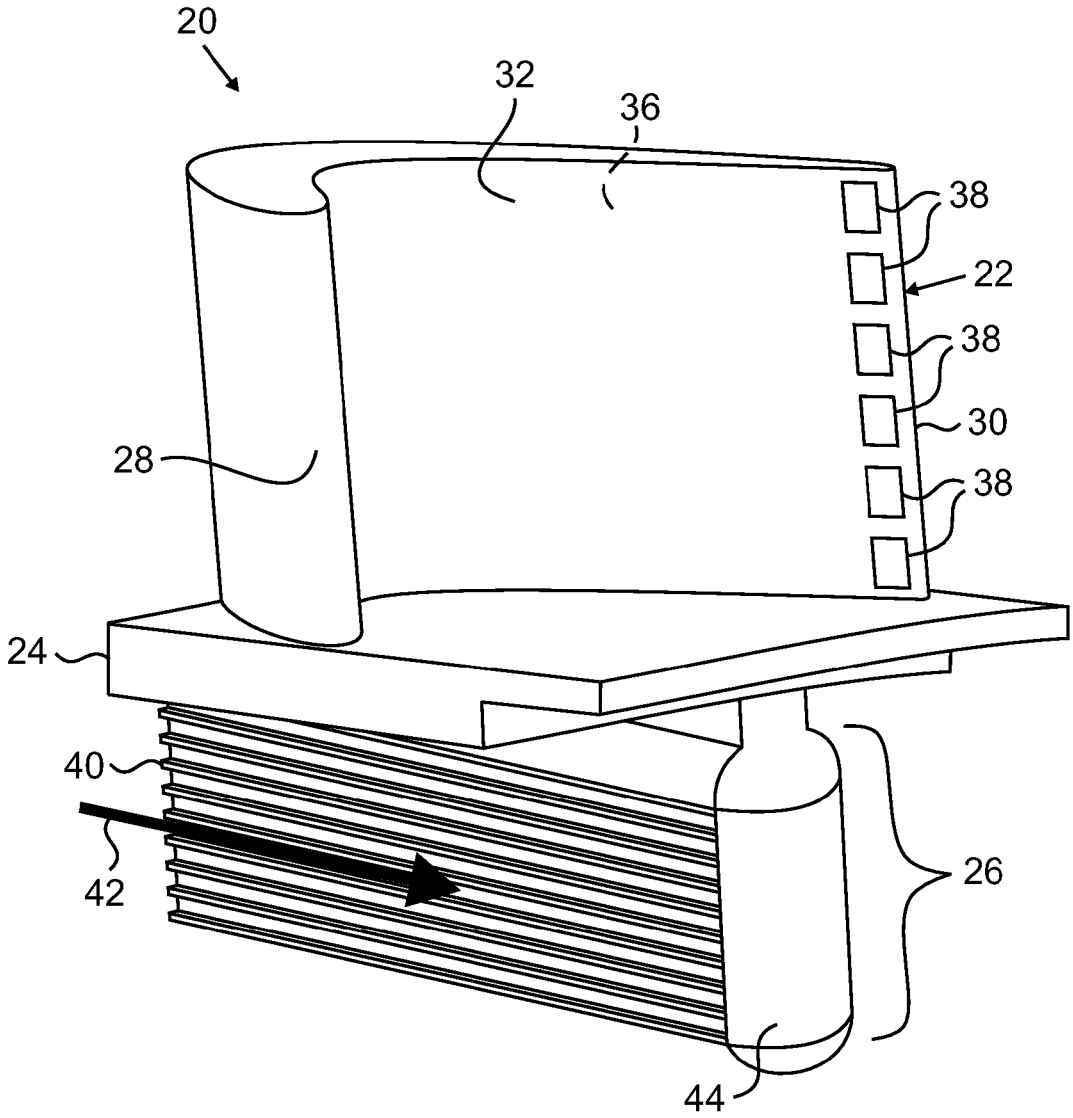
FIG. 1 is a perspective view of a portion of a turbine blade according to the present invention.

FIG. 1 is a perspective view of a portion of a turbine blade 20 for a gas turbine engine. The blade 20 includes an airfoil 22 (in the interest of simplicity, only a portion of the airfoil 22 is shown in FIG. 1, and the internal structures of the airfoil 22 are not shown in cross section), a platform 24, and a root portion 26.

The airfoil 22 is an aerodynamically shaped fluid reaction member that extends outward from the platform 24 and is positionable within a flowpath of the engine to perform work with respect to fluid moving along the flowpath. The airfoil 22 defines a leading edge 28, a trailing edge 30, a pressure side 32 and a suction side 34 (not visible in FIG. 1). As will be explained further below, a vaporization chamber 36 is located inside the airfoil 22 at its leading edge 28. A number of film cooling openings 38 are located at the trailing edge 30 of the airfoil 22. The openings 38 are slots similar to known film cooling slots for gas turbine airfoils. The total number of openings 38 will vary depending upon the desired amount of film cooling.

The particular configuration of the airfoil 22 as shown in FIG. 1 is merely exemplary. It should be understood that the particular configuration of the airfoil 22 and other structures of the blade 20 will vary according to the desired application.

The root portion 26 forms a dovetail shape (e.g., a single lug shape, fir tree shape, etc.) for retaining the blade 20 in a corresponding slot (not shown) in a conventional manner. In the illustrated embodiment, the root portion 26 of the blade 20 is configured to be retained in an axially oriented slot formed in an outer rim of a rotor disk (not shown). The root portion 26 also contains a condenser 40 that is linked to the vaporization chamber 36. Airflow 42 can be directed along the exterior of the condenser 40 to remove thermal energy, as will be explained in greater detail below.

Figure 2:
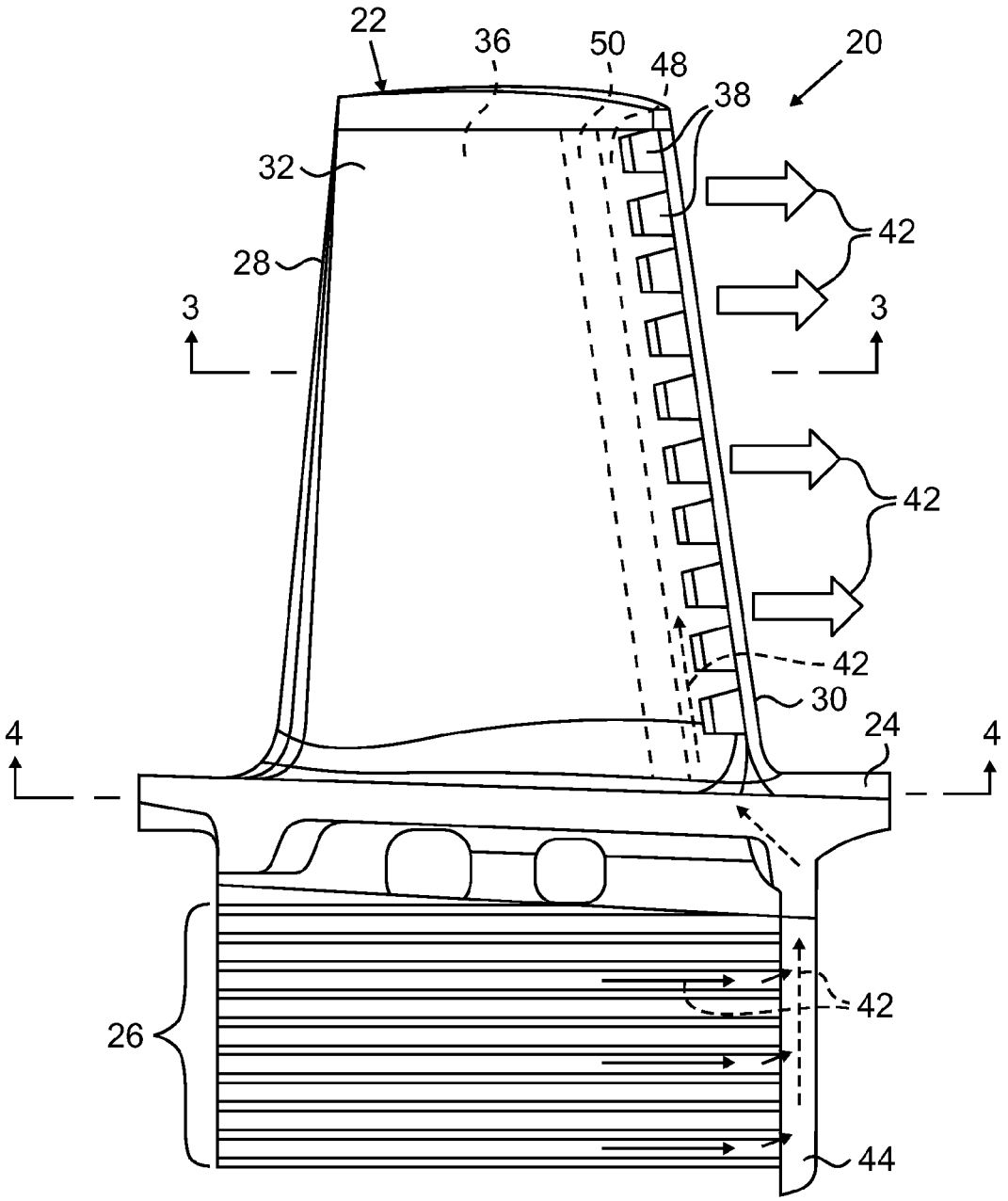
FIG. 2 is a side view of the turbine blade of FIG. 1.
Figure 3:
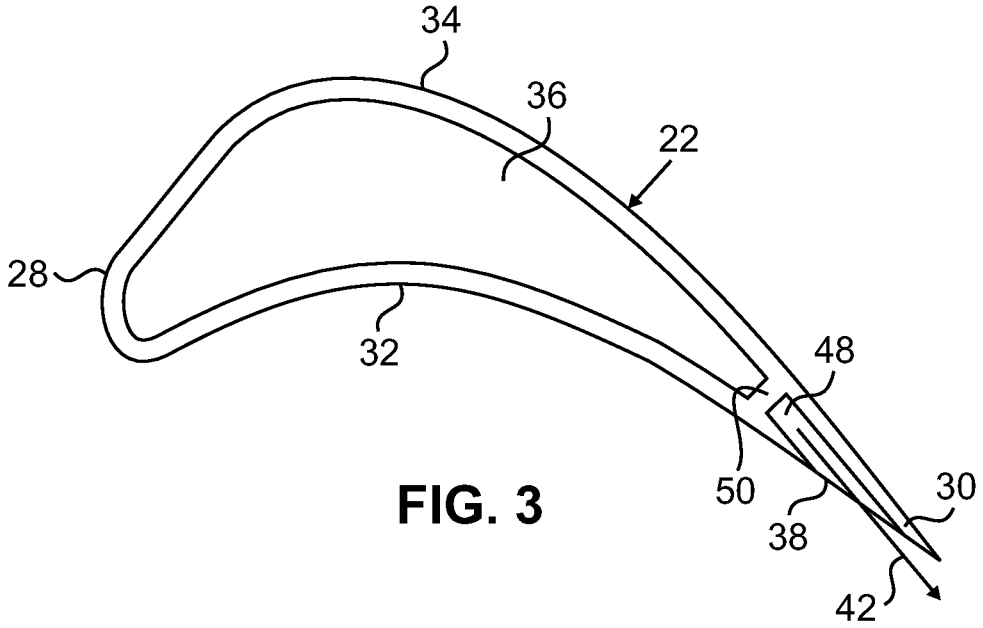
FIG. 3 is a cross-sectional view of the turbine blade, taken along line 3-3 of FIG. 2.
Figure 4:
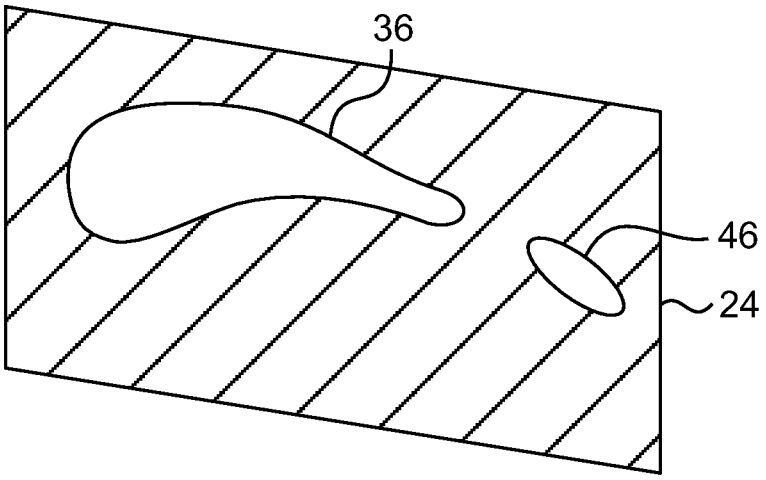
FIG. 4 is a cross-sectional view of the turbine blade, taken along line 4-4 of FIG. 2.

FIG. 2 is a side view of the turbine blade 20. FIG. 3 is a cross-sectional view of the turbine blade 20 taken along line 3-3 of FIG. 2, and FIG. 4 is a cross-sectional view of the turbine blade 20 taken along line 4-4 of FIG. 2. As shown in FIG. 2, an optional flow deflector 44 is located at an aft end of the blade root 26. The flow deflector 44 can have a scoop-like shape that extends beyond the inner end of the root 26 in manner similar to the flow deflector disclosed in U.S. Pat. No. 6,974,306 by Djeridan et al. The flow deflector 44 redirects at least a portion of the airflow 42, and typically redirects most of the airflow 42 from a generally axial direction to a generally radially outward direction. As shown in FIGS. 3 and 4, the redirected airflow 42 can then flow through an internal passageway 46 through the root portion 26 and the platform 24 to an airflow chamber 48 inside the airfoil 22. The openings 38 extend to the airflow chamber 48, such that airflow 42 can pass out of the airflow chamber 48 through the openings 38 to provide film cooling to the thin portion of the airfoil 22 at the trailing edge 30 in a conventional manner. The film cooling process is explained further below.

As shown in FIG. 3, the airflow chamber 48 is located at or near the trailing edge 30 of the airfoil 22, and the vaporization section 36 is located at or near the leading edge 28 of the airfoil 22. An internal wall 50 is defined by the airfoil 22 between the airflow chamber 48 and the vaporization chamber 36. In one embodiment, the wall 50 can be about 30 mil in an axial direction. The location and precise dimensions of the wall 50 will be determined as function of the heat load on the blade 20 in a particular application Likewise, the relative sizes and configurations of the vaporization chamber 36 and the airflow chamber 48 will also be determined as function of heat loading.

The vaporization chamber 36 and the condenser 40 form a vapor cooling subsystem that provides cooling to a portion of the airfoil 22 at or near the leading edge 28. In the illustrated embodiment, the vaporization chamber 36 is shown in a simplified form. However, the vaporization chamber 36 can be configured in any suitable manner. A fluid is contained within the vapor cooling subsystem, and can pass between the vaporization chamber 36 and the condenser 40. In a liquid state, the fluid is distributed to the vaporization chamber 36, where the liquid fluid absorbs thermal energy and is converted to a gaseous state when its boiling point is reached. The gaseous fluid then passes to the condenser 40, which removes thermal energy to convert the fluid back to the liquid state. The liquid fluid can then be returned to the vaporization chamber 36 and the process continued.

Figure 5:
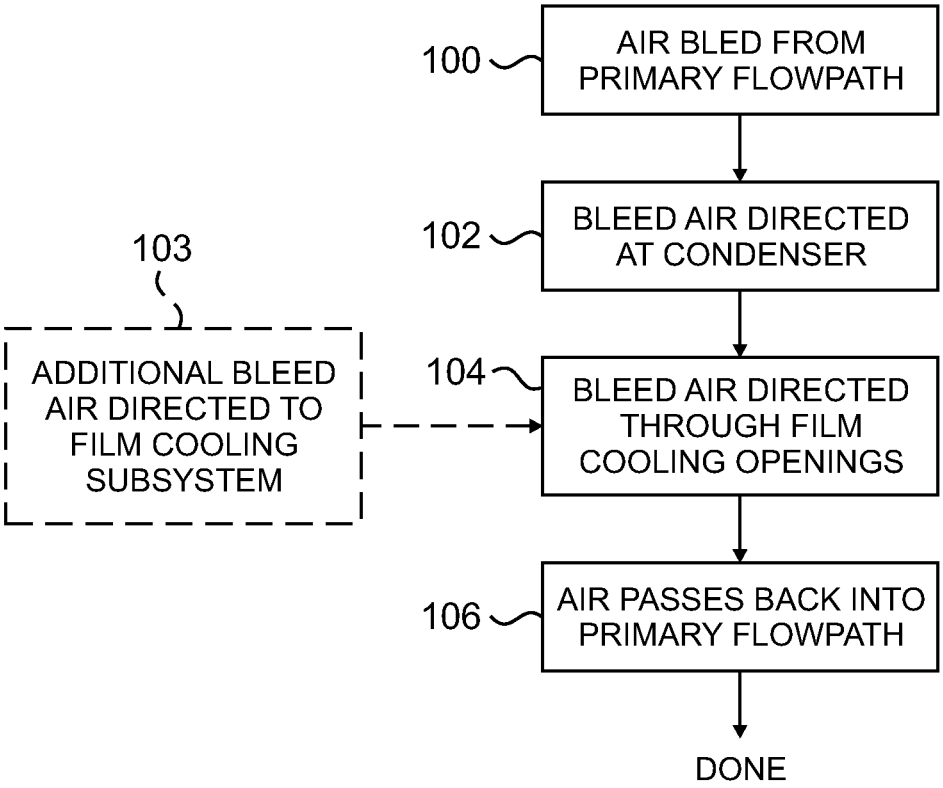
FIG. 5 is a flow chart detailing steps performed to cool the turbine blade.

In operation, the present invention provides cooling to the blade 20. FIG. 5 is a flow chart detailing steps performed to cool the turbine blade 20. While in use, the airfoil 22 is subjected to high temperature conditions as hot gases move through the primary flowpath of the engine in which the blade 20 is installed. The vaporization subsystem absorbs thermal energy with the fluid present in the vaporization chamber 36 and transfers that absorbed thermal energy to the condenser 40. At the same time, air is bled from the primary flowpath (step 100), for example compressor bleed air is taken from a suitable compressor stage. At least some of the bleed air is then routed to the location of the blade 20 and directed at the exterior surfaces of the condenser 40 in airflow 42 (step 102). Typically, the bleed air is directed into a disk slot in which the root portion 26 is retained, allowing the airflow 42 to pass through one or more gaps between the disk slot and the condenser 40 in the root portion 40. As the bleed air in the airflow 42 passes the condenser 40, the bleed air absorbs thermal energy from the fluid inside the condenser 40. At least some of the bleed air in the airflow 42 is then redirected by the flow deflector 44 and through the internal passageway 46. Some additional thermal energy can be absorbed by the bleed air while in the internal passageway 46. It is desired to redirect close to 100% of the bleed air into the passageway 46. Optionally, additional bleed air not used to cool the condenser 40 can be introduced to the passageway 46 to bolster film cooling (step 103). Next, the bleed air in the airflow 42 passes from the passageway 46 to the airflow chamber 48 and through the openings 38 at the trailing edge 30 of the airfoil 22 (step 104). As the bleed air leaves the openings 38, it passes over the exterior surface of the airfoil 22 to provide film cooling in a conventional manner. After leaving the openings 38, the bleed air is exhausted into the engine's primary airflow in a direction that is generally parallel with the primary airflow (step 106). In this way, the hybrid cooling system of the present invention utilizes vapor cooling to cool a large portion of the airfoil 22 of the blade 20 at or near its leading edge 28. Film cooling is then used to cool a portion of the airfoil 22 at or near the trailing edge 30, which is difficult to cool using vapor cooling alone.

By using the same bleed air to both cool the condenser 40 and to provide film cooling through the openings 38, it is possible to return almost all of the bleed air used for cooling the blade 20 to the primary flowpath. Furthermore, by exhausting bleed air generally parallel to the primary flowpath, mixing loss is reduced. These factors help promote engine power efficiency and fuel efficiency, and facilitate thrust-specific fuel consumption (TSFC). In addition, the hybrid cooling system of the present invention allows a high degree of cooling to be provided to the blade 20, which can help improve the lifespan of the blade 20.

Although the present invention has been described with reference to preferred embodiments, workers skilled in the art will recognize that changes may be made in form and detail without departing from the spirit and scope of the invention. For instance, the hybrid cooling system of the present invention can be applied to a variety of gas turbine engine components, including nearly any type of blade or vane having an airfoil.

The status of the claims is as follows:

1. A cooling system for cooling a fluid reaction apparatus of a gas turbine engine, the system comprising:

a vapor cooling subsystem having a vaporization section and a condenser section for cooling a portion of the fluid reaction apparatus, the vapor cooling subsystem having a medium therein that condenses to a liquid state and vaporizes to a gaseous state to transfer thermal energy during operation, wherein the condenser section is cooled by a fluid;

a film cooling subsystem for cooling a portion of the fluid reaction apparatus by discharging fluid out of openings defined in the fluid reaction apparatus, wherein at least a portion of the fluid used to cool the condenser section of the vapor cooling subsystem is discharged out of the openings of the film cooling subsystem; and a flow deflector located at or near a downstream portion of the condenser section for directing the fluid used to cool the condenser section to the film cooling subsystem.

2. The system of claim 1, wherein the fluid reaction apparatus is a turbine blade.

3. The system of claim 2, wherein the vapor cooling subsystem provides cooling to a leading edge portion of the turbine blade.

4. The system of claim 2, wherein the turbine blade includes an airfoil and a root, and wherein the vaporization section of the vapor cooling subsystem is defined within the airfoil and the condenser section of the vapor cooling subsystem is defined within the root.

5. The system of claim 4, wherein the flow deflector extends from the root for directing fluid into the film cooling subsystem.

6. The system of claim 1, wherein the openings defined in the fluid reaction apparatus are each slot-shaped.

7. The system of claim 1 and further comprising:

a wall defined by a portion of the fluid reaction apparatus, wherein the wall separates the vaporization section of the vapor cooling subsystem and the openings of the film cooling subsystem.

8. The system of claim 1, wherein the flow deflector is configured to redirect the fluid used to cool the condenser section from a generally axial direction to a generally radially outward direction.

9. A hybrid cooling system for cooling a gas turbine engine component having an airfoil portion and a root portion, the system comprising:

a first cooling subsystem for cooling a region at or near a leading edge of the airfoil portion, wherein the first cooling subsystem utilizes vapor cooling in which a medium therein condenses to a liquid state and vaporizes to a gaseous state to transfer thermal energy during operation, and wherein the first cooling subsystem includes a vaporizer section within the airfoil portion and a condenser section within the root portion; and a second cooling subsystem for cooling a region at or near a trailing edge of the airfoil portion, wherein the second cooling subsystem utilizes film cooling.

10. The system of claim 9, wherein the condenser section is cooled by a fluid directed at the root portion.

11. The system of claim 10, wherein the fluid directed at the root portion to cool the condenser section is subsequently directed through the second cooling subsystem.

12. The system of claim 11, wherein the second cooling subsystem is configured to distribute at least a portion of the fluid into a primary flow path of the gas turbine engine.

13. The system of claim 11 and further comprising:

a flow deflector extending from the root portion downstream of the condenser section for directing fluid into the second cooling subsystem.

14. The system of claim 9, wherein the region at or near the trailing edge is located downstream from the vaporizer section.

15. An improvement for a vapor cooled gas turbine engine component having a leading edge and a trailing edge, and further having a condenser section and a vaporization section, the component having a medium therein that condenses to a liquid state and vaporizes to a gaseous state to transfer thermal energy during operation, the improvement comprising:

an auxiliary cooling system for cooling a region at or near the trailing edge of the gas turbine engine component using film cooling, wherein the region at or near the trailing edge is located downstream from the vaporization section, and wherein at least a portion of a fluid used to cool the condenser section is discharged out of a plurality of openings of the auxiliary cooling subsystem, such that the fluid used for film cooling includes thermal energy transferred from the condenser section.

16. The improvement of claim 15, wherein a vaporization section of the vapor cooled gas turbine engine component is separated from the auxiliary cooling system by an internal wall.

17. The improvement of claim 15 and further comprising:

a flow deflector for redirecting the fluid used to cool a portion of a vapor cooling system of the vapor cooled gas turbine engine component to the auxiliary cooling subsystem.

18. The improvement of claim 17, wherein the flow deflector extends from a downstream region of a root portion of the gas turbine engine component.

19. The improvement of claim 15 and further comprising:

a flow deflector located at or near a downstream portion of the condenser section for directing the fluid used to cool the condenser section to the auxiliary cooling subsystem.

20. The improvement of claim 15 and further comprising:

a flow deflector located at or near a downstream portion of the condenser section for directing the fluid passing in a generally axial direction to cool the condenser section to a generally radially outward direction and to the auxiliary cooling subsystem.

* * * * *